US006478534B2

(12) United States Patent
Bangert et al.

(10) Patent No.: US 6,478,534 B2
(45) Date of Patent: Nov. 12, 2002

(54) TURBINE CASING

(75) Inventors: Boris Bangert, Stuttgart; Edwin Gobrecht, Ratingen; Norbert Henkel, Düsseldorf; Uwe Zander, Mülheim a.d. Ruhr, all of (DE)

(73) Assignee: Siemnes Aktiengesellschaft, Munich (DE)

( * ) Notice: Subject to any disclaimer, the term of this patent is extended or adjusted under 35 U.S.C. 154(b) by 52 days.

(21) Appl. No.: 09/789,782

(22) Filed: Feb. 20, 2001

(65) Prior Publication Data

US 2001/0022933 A1 Sep. 20, 2001

Related U.S. Application Data

(63) Continuation of application No. PCT/DE99/02435, filed on Aug. 5, 1999.

(30) Foreign Application Priority Data

Aug. 18, 1998 (DE) ..... 198 37 399

(51) Int. Cl.[7] ..... F01D 25/14

(52) U.S. Cl. ..... 415/1; 415/108; 415/175; 415/116

(58) Field of Search ..... 415/108, 175–178, 415/116, 1

(56) References Cited

U.S. PATENT DOCUMENTS

| | | | | |
|---|---|---|---|---|
| 4,498,301 A | 2/1985 | Tsubouchi | ..... | 60/657 |
| 5,388,960 A | 2/1995 | Suzuki | ..... | 415/176 |

FOREIGN PATENT DOCUMENTS

| | | |
|---|---|---|
| DE | 3420389 A1 | 12/1985 |
| EP | 0014941 A1 | 9/1980 |
| GB | 813330 | 5/1959 |

OTHER PUBLICATIONS

Japanese Patent Abstract No. 02081905 (Akihisa), dated Mar. 22, 1990.

Published International Application No. 98/13588 (Gobrecht et al.), dated Apr. 2, 1998.

*Primary Examiner*—Edward K. Look
*Assistant Examiner*—Dwayne J. White
(74) *Attorney, Agent, or Firm*—Laurence A. Greenberg; Werner H. Stemer; Ralph E. Locher

(57) ABSTRACT

A turbine casing has an inner casing and an outer casing which surrounds the inner casing to form an intermediate space. In order to avoid a casing distortion, a forced flow of a medium located within the intermediate space is provided. A method is also described which relates to avoiding a temperature based casing distortion during the shut-down of a turbine.

6 Claims, 1 Drawing Sheet

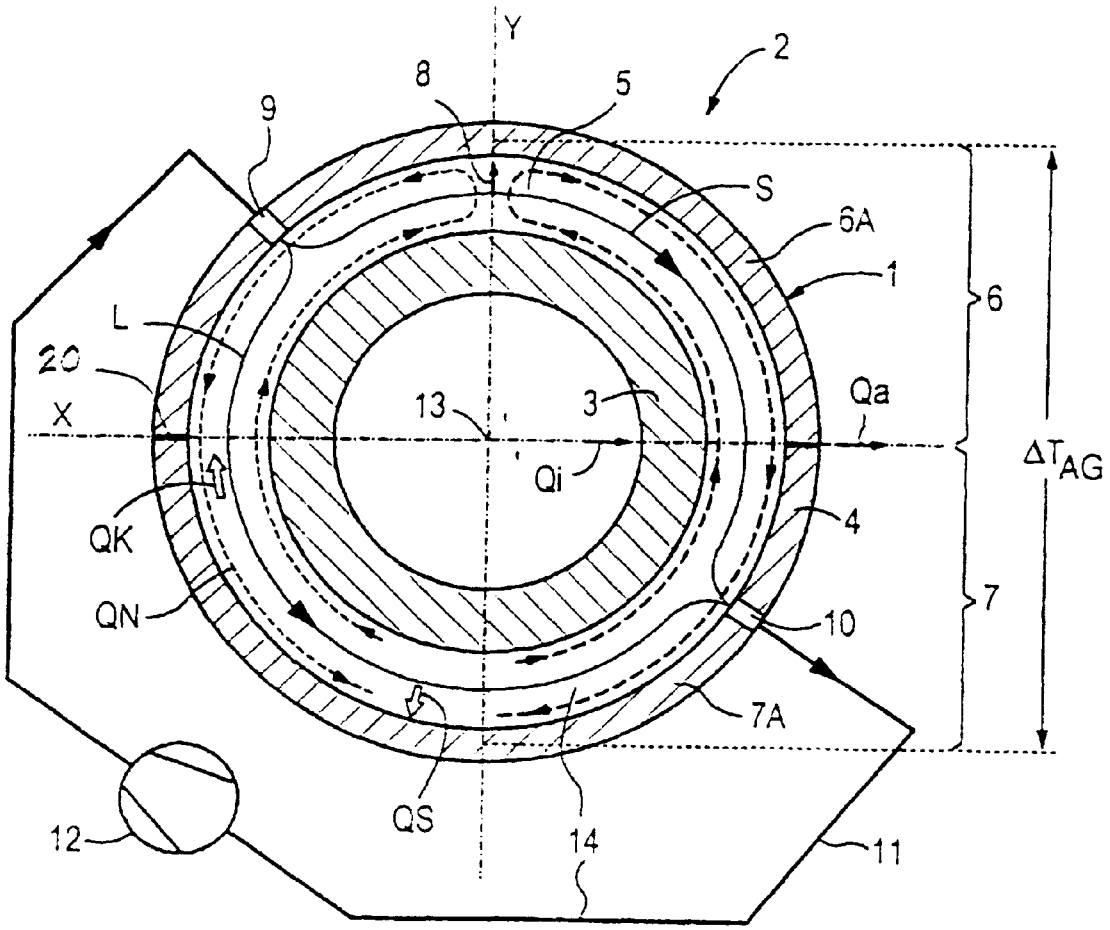
Y
2
8
5
9
S
6A
1
6
L
20
X
13
3
Qa
Qi
$\Delta T_{AG}$
QK
4
QN
10
7
7A
QS
12
14
11

TURBINE CASING

CROSS-REFERENCE TO RELATED APPLICATION

This application is a continuation of copending International Application No. PCT/DE99/02435, filed Aug. 5, 1999, which designated the United States.

BACKGROUND OF THE INVENTION

FIELD OF THE INVENTION

The invention relates to a turbine casing having an inner casing and an outer casing which surrounds the inner casing to form an intermediate space.

The turbine casing of, for example, a steam turbine is usually built up from an inner casing and an outer casing surrounding the inner casing to form an intermediate or annular space. The two casing parts respectively have, in turn, an upper half and a lower half. Particularly after the turbine has been shut down, temperature differences appear on the casings and between them and these differences can be more than 50° K between the lower half and the comparatively hotter upper half. If the turbine is shut down, the outer casing cools more rapidly than the inner casing. Because of this, due to free or natural convection in the intermediate space, an upward flow is induced between the inner casing and the outer casing and this causes an input of heat into the upper half of the outer casing. This can, in turn, lead to casing distortion, particularly in the upper half of the outer casing, with the result that undesirable casing material stresses and clearance closures occur there. A distortion of the inner casing also can lead to undesirable rubbing damage if, in unfavorable cases, turbine blades rub on the casing.

Published, Non-Prosecuted German Patent DE 34 20 389 A1 discloses a steam turbine having an inner casing and an outer casing surrounding the inner casing, an intermediate space being formed by this double-shell casing construction. In its axial extent, the inner casing is at least partially covered by a shell that is disposed in the intermediate space.

At an inlet end, the shell is connected to a piston seal and, at an outlet end, the shell has a plurality of openings distributed around the periphery. During operation of the steam turbine, the shell ensures that the relatively cold exhaust steam cannot flow around the inner casing. For this purpose, hot steam that is taken from the piston seal flows between the shell and the inner casing. This causes a heat build-up effect in the space formed by the shell and the inner casing so that the inner casing is substantially protected from excessive cooling by the cold exhaust steam. This serves to avoid different temperature loadings on the inner casing and therefore reduces thermally induced deformations of the same, in particular during start-up and in load-change operation.

U.S. Pat. No. 5,388,960 describes a device for the forced cooling of a single-flow steam turbine. The steam turbine has a double-casing construction with an inner casing and an outer casing surrounding the inner casing to form an intermediate space. After the flow of live steam has been switched off, the steam turbine is brought to a desired cooled temperature in the shortest possible time by a cooling device. For this purpose, atmospheric air is induced, compressed and cooled in a heat exchanger. The air pretreated in this way is supplied to the intermediate space for cooling purposes by a respective inlet opening in the upper casing half and the lower casing half of the outer casing. After flowing through the intermediate space in the axial direction, the air passes via the outlet-flow connection of the steam turbine out of the intermediate space again and is released via an outlet valve. In this configuration, temperature differences which occur between the upper casing halves and the lower casing halves, which appear as a consequence of uneven cooling-air flow, as well as axial differential expansions, are monitored by appropriate measuring devices. The measurement signals are used for controlling the cooling transients.

SUMMARY OF THE INVENTION

It is accordingly an object of the invention to provide a turbine casing which overcomes the above-mentioned disadvantages of the prior art devices and methods of this general type, in which a distortion of the outer casing is prevented or at least reduced, in particular during cooling of the turbine.

With the foregoing and other objects in view there is provided, in accordance with the invention, a turbine casing. The turbine casing has an inner casing and an outer casing surrounding the inner casing and defining an intermediate space there-between, the outer casing has a first opening and a second opening formed therein. A circulating fan system connects the first opening to the second opening so that a forced flow of a medium located within the intermediate space can be generated. The first opening, the second opening, the intermediate space and the circulating fan system together define a closed circuit.

The first-mentioned object is achieved, according to the invention, by a turbine casing having an inner casing and an outer casing surrounding the inner casing to form an intermediate space. A first opening and a second opening are formed in the outer casing. The first opening is connected to the second opening by a circulating fan system, so that a forced flow of the medium located within the intermediate space can be generated in a closed circuit formed from the casings and the circulating fan system.

The object directed towards a method is achieved, according to the invention, by a method that avoids a casing distortion of the turbine casing when the turbine is shut down. More specifically, in the intermediate space formed between the inner casing and the outer casing surrounding the inner casing, a forced flow of the medium located in the intermediate space is generated in the closed circuit in order to even out the temperature distribution in the turbine casing.

The invention follows from the consideration that evening out of the temperature distribution, particularly in the outer casing, can be achieved by acting against the free convection flow arising in the intermediate space between the inner casing and the outer casing. The convection flow (natural convection) namely leads, on the one hand, to temperature differences between the casing parts, in particular between the two casing halves of the outer casing, and to the formation of upwardly directed convection streaks on the other. These, in turn, cause a local heat input, mainly at a vertical apex point of the intermediate space, into the upper half of the outer casing. It is possible to act against this effect in a suitable manner by an active circulation or eddying of the medium within the intermediate space so that a convection flow no longer builds up.

For this purpose, the medium is guided in a circuit that is expediently closed by a ducting system outside the turbine casing. In order to generate a forced and directed flow, a circulating fan is provided whose suction side and whose pressure side are respectively connected to an opening in the outer casing. The suction-side opening forms an outlet-flow opening for the medium whereas the pressure-side opening forms an inlet-flow opening. The inlet-flow opening and the outlet-flow opening are respectively configured as connection openings in such a way that an inlet-flow duct can be connected to the inlet-flow opening and an outlet-flow duct can be connected to the outlet-flow opening.

It is particularly advantageous for one of the openings to be provided in the lower half of the outer casing and for the other opening to be provided in the upper half of the outer casing. In a coordinate system intersecting in the central middle axis of the turbine casing, the two openings are, for example, in the second and fourth quadrants and are diametrically opposite. It is also possible for the first opening to be disposed in the first quadrant and the second opening to be disposed in the third quadrant. The inlet-flow opening is preferably provided in the upper half and the outlet-flow opening is provided in the lower half of the outer casing. Due to the two connection openings on the turbine casing and due to a corresponding duct routing with the circulating fan employed, only a very slight additional operative complication occurs overall. In a preferred embodiment, the outer casing is in two parts, the upper half being formed by an upper part and the lower half being formed by a lower part, the upper part and the lower part being connected together by a split joint.

The turbine casing is advantageously employed as the casing of a steam turbine. Applications of the turbine casing are particularly suitable both for high-pressure steam turbines and for medium-pressure steam turbines. In these, the temperature of the hot steam that drives the turbine is between approximately 300° C. and 700° C. The material of the casings, in particular the inner casing, is subjected to these high temperatures. The heat stored in the inner casing and in the outer casing must be removed as evenly as possible from the casings after the steam turbine is shut down, i.e. after the steam flow in the turbine is switched off. In the case of a high-pressure steam turbine, the turbine casing specified can be advantageously employed because of the generally very compact construction and the associated high heat flow density through the inner casing and outer casing. In a medium-pressure steam turbine, it is mainly the relative length changes occurring over its larger dimension which is critical for casing distortion after the turbine is shut down. These critical thermal expansions are effectively avoided by the turbine casing specified above. In addition to the applications in high-pressure and medium-pressure steam turbines, employment possibilities in the case of low-pressure steam turbines also arise.

The advantages achieved by the invention relate, in particular, in the fact that the evening out of the temperature distribution in the outer casing occurs in a particularly simple manner due to a forced, preferably directed flow of the medium in the intermediate space of the turbine casing built up from the inner casing and from the outer casing surrounding the inner casing.

In this configuration, the natural convection usually occurring during shut-down of the turbine is reliably prevented and a temperature difference between the outer casing and the inner casing and, between the upper half and the lower half of the outer casing, are kept small so that a casing distortion, a so-called cat's back, is reliably avoided. The additional complexity in terms of apparatus necessary for generating the flow can be kept particularly small, especially since only one circulating fan is necessary for an active circulation or eddying of the medium, for example air, located in the intermediate space. A circulating fan is advantageously located within a ducting system routed outside the turbine casing.

Other features which are considered as characteristic for the invention are set forth in the appended claims.

Although the invention is illustrated and described herein as embodied in a turbine casing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a diagrammatic, sectional view of a turbine casing according to the invention.

DESCRIPTION OF THE PREFERRED EMBODIMENT

Referring now to the single FIGURE of the drawing in detail, there is shown a turbine casing 1 of, for example, a steam turbine 2 whose further components, for example its turbine shaft and turbine blades, are not shown for simplicity. The turbine casing 1 has an inner casing 3 and an outer casing 4 which surrounds the inner casing 3, preferably concentrically. The inner casing 3 and the outer casing 4 are then at a distance from one another in such a way that an intermediate space 5 is formed. The intermediate space 5 is filled with a gaseous medium L, for example air, which is capable of convection. The inner casing 3 and the outer casing 4 can be respectively subdivided into a first, upper partial region or upper half 6, and into a second, lower partial region or lower half 7. The inner casing 3 and the outer casing 4 can be respectively configured in two parts, the upper half 6 being formed by an upper part 6A and the lower half 7 being formed by a lower part 7A. The upper part 6A and the lower part 7A are then connected together by a split joint 20 that extends for example along the X axis.

If a heat flow through the turbine casing 1 is considered, there is an inner heat flow Qi through the inner casing 3 and an outer heat flow Qa though the outer casing 4. In addition to a radiation heat flow QS, which acts from the inner casing 3 onto the outer casing 4, a thermal convection flow QK appears between the inner casing 3 and the outer casing 4. If the turbine 2 were shut down, a free or natural convection flow—designated below as the natural convection QN—would occur whose thermal flow course is shown by the interrupted line provided with arrowheads. Particularly in the region of the apex of the intermediate space 5, the natural convection QN would lead to the formation of a convection streak symbolized by an arrow 8 with a local heat input into the outer casing 4 in the region of its upper half 6. A local heat input of this type can, as a consequence of high thermal loading, lead to an undesirable casing distortion.

The formation of such a natural convection QN, which would in addition lead to a temperature difference $\Delta T_{AG}$ between the upper half 6 and the lower half 7, is prevented by a directed flow, symbolized by a full line S, being actively generated and therefore being forced in the intermediate space 5.

For this purpose, the outer casing 4 has two, preferably diametrically opposite, openings 9, 10 which are in connection with one another by use of a circulating fan 12 provided within a ducting system 11.

In the exemplary embodiment, the first connection or inlet-flow opening 9 is provided in the second quadrant of a (virtual) XY coordinate system intersecting on a turbine longitudinal axis 13. The second connection or outlet-flow opening 10 is then located in the fourth quadrant of the XY coordinate system. The outlet-flow opening 10 can also be located in the third quadrant. A plurality of the openings 9, 10 can also be provided. As an example, the inlet-flow opening 9 can be provided in the second quadrant and two of the outlet-flow openings 10 can be provided in the first and third quadrants. It is also possible for a plurality of the openings 9, which are the inlet-flow openings 9 for the medium L, to be provided. These are then advantageously disposed on the upper half 6 of the outer casing 4.

In the configuration, a suction side of the circulating fan 12 is connected by the ducting system 11 to the connection opening 10 provided in the lower half 7 of the outer casing 4. The pressure side of the circulating fan 12 is then connected by the ducting system 11 to the connection opening 9 located in the upper half 6 of the outer casing 4.

The circulating system for generating the forced flow S through the intermediate space 5 of the turbine casing 1 is advantageously put into operation after the turbine 2 has been shut down. When the circulating fan 12 is running, the medium L located in the intermediate space 5 is guided out from the intermediate space 5 via the connection opening 10 and is guided back into the intermediate space by the ducting system 11 and the circulating fan 12 via the connection opening 9. Overall, therefore, a closed circuit 14 is provided by the intermediate space 5 and the ducting system 11.

The formation of the free convection or the natural convection QN is prevented by the forced flow S of the medium L in the intermediate space 5 so that the temperature difference $\Delta T_{AG}$ arising between the upper half 6 and the lower half 7 of the outer casing 4 is substantially avoided or at least kept as small as possible. The forced flow S, however, primarily causes an evening out of the temperature distribution in the outer casing 4.

Therefore, temperature gradients are substantially prevented and relative thermal expansions, in particular between the upper half 6 and the lower half 7, and thermal stresses are therefore limited.

Because of the evening out of the temperature distribution in the outer casing 4 effected by the forced flow S, therefore, action is taken against the natural convection QN in such a way that casing distortions are reliably prevented after shut-down during cooling of the turbine 2, for example of a steam turbine 2.

We claim:

1. A turbine casing, comprising:

an inner casing;

an outer casing surrounding said inner casing and defining an intermediate space therebetween, said outer casing having a first opening and a second opening formed therein; and a circulating fan system connecting said first opening to said second opening so that a forced flow of a medium located within said intermediate space can be generated, said first opening, said second opening, said intermediate space, and said circulating fan system defining a closed circuit.

2. The turbine casing according to claim 1, wherein said first opening and said second opening are disposed diametrically opposite on said outer casing.

3. The turbine casing according to claim 1, wherein said outer casing and said inner casing are formed to house a steam turbine.

4. The turbine casing according to claim 1, wherein said first opening is formed in an upper half of said outer casing and said second opening is formed in a lower half of said outer casing.

5. The turbine casing according to claim 4, wherein said outer casing is formed in two parts including an upper part defining said upper half and a lower part defining said lower half, and including a split joint connecting said upper part to said lower part.

6. A method for avoiding a casing distortion of a turbine casing when a turbine is shut down, which comprises the steps of:

generating a forced flow of a medium in an intermediate space formed between an inner casing and an outer casing surrounding the inner casing, the intermediate space being part of a closed circuit and the forced flow evening out a temperature distribution in the turbine casing.

* * * * *